US007703880B2

(12) United States Patent
Tanaka et al.

(10) Patent No.: US 7,703,880 B2
(45) Date of Patent: Apr. 27, 2010

(54) INKJET RECORDING APPARATUS

(75) Inventors: Hiroyuki Tanaka, Kawasaki (JP); Aya Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 369 days.

(21) Appl. No.: 11/128,214

(22) Filed: May 13, 2005

(65) Prior Publication Data

US 2005/0259126 A1 Nov. 24, 2005

(30) Foreign Application Priority Data

May 18, 2004 (JP) ..... 2004-148097

(51) Int. Cl.
*B41J 2/165* (2006.01)

(52) U.S. Cl. ..... 347/33; 347/29

(58) Field of Classification Search ..... 347/33, 347/29, 31, 32

See application file for complete search history.

(56) References Cited

U.S. PATENT DOCUMENTS 6,033,052 A * 3/2000 Muraki ..... 347/33
6,109,725 A 8/2000 Saikawa et al.
6,164,754 A * 12/2000 Ide et al. ..... 347/33
6,422,686 B1 * 7/2002 Ishinaga et al. ..... 347/47
6,913,340 B2 * 7/2005 Tanaka et al. ..... 347/29
0,275,680 A1 12/2005 Inoue
2002/0036671 A1 * 3/2002 Takahashi et al. ..... 347/29
2002/0101461 A1 * 8/2002 Su et al. ..... 347/1
2002/0118247 A1 * 8/2002 Fukasawa et al. ..... 347/29
2002/0122092 A1 * 9/2002 Okamura et al. ..... 347/33
2003/0227505 A1 * 12/2003 Tanaka et al. ..... 347/29
2005/0190228 A1 * 9/2005 Takagi ..... 347/30

FOREIGN PATENT DOCUMENTS

JP 2000-15832 1/2000

* cited by examiner

*Primary Examiner*—Stephen D Meier
*Assistant Examiner*—Sarah Al-Hashimi
(74) *Attorney, Agent, or Firm*—Fitzpatrick, Cella, Harper & Scinto

(57) ABSTRACT

An inkjet recording apparatus with a simple and inexpensive configuration, in which a relative position between a recording unit and a wiper can be controlled at an appropriate position in wiping a discharge port surface, is provided. The inkjet recording apparatus can securely perform the wiping, even if a convex part is formed on the discharge port surface. In wiping a discharge port surface, a wiper holder abuts onto a carriage or a recording unit to position not only a relative position between wipers and the carriage or the recording unit in a direction perpendicular to the discharge port surface, but also a relative position in the direction of discharge port arrays of the discharge port surface.

6 Claims, 12 Drawing Sheets

INKJET RECORDING APPARATUS

BACKGROUND OF THE INVENTION

1. Field of the Invention

The present invention relates to an inkjet recording apparatus which performs recording by discharging ink to a recording material from recording means mounted on a reciprocating carriage.

2. Description of the Related Art

In a direction orthogonal to a direction in which recording materials such as a recording sheet of paper and a plastic thin plate are conveyed, a serial scan type recording apparatus performs main scan through a recording portion. In the serial scan type recording apparatus, an image is recorded with recording means (recording head) mounted on a carriage which moves along the recording material, the recording material is conveyed by a predetermined amount after recording of one line, and the image of the next line is recorded onto the recording material which is stopped again. The above operations are repeated, thereby recording onto the whole recording material. In the inkjet recording apparatus, one of such serial scan type recording apparatuses, which performs the recording by discharging the ink from the recording means, the recording means is easily made compact, a fine image can be recorded at high speed, and the recording can be performed to a sheet of plain paper with no special process. Further, the inkjet recording apparatus has advantages in that running cost is low, noise is little because of non-impact type recording method, and a color image is easily recorded with multi-color ink.

In the inkjet recording apparatus, when the ink in an ink tank runs out as a result of the recording, the ink tank is replaced with a new ink tank, and the ink is refilled into a flow path extending to the ink discharge portion. Further, in the inkjet recording apparatus, it is necessary to perform a recovery process of removing foreign matters such as adhesive ink near a discharge port and bubbles in the recording means. Namely, in order to stabilize an ink discharging action of the recording means to obtain good image quality, the inkjet recording apparatus generally has a recovery mechanism unit (cleaning mechanism unit) which maintains and recovers ink discharging performance of the recording means. The recovery mechanism unit usually includes a cap, suction recovery means, and wiping means. The discharge ports are covered with the cap by closely contacting a discharge port surface of the recording means. The suction recovery means sucks the thickened ink in the discharge port and the waste ink in the cap by introducing negative pressure into the cap. The wiping means cleans the discharge port surface by wiping the ink adhering to the discharge port surface with a wiper.

FIG. 12 is a front view showing a conventional recovery mechanism unit while the cap is opened, FIG. 13 is a front view showing the recovery mechanism unit shown in FIG. 12 while the capping state is partially broken away, and FIG. 14 a front view showing the conventional recovery mechanism unit of FIG. 12 while a cap slider (slide member) is fixed by a lock lever. In FIGS. 12 to 14, a carriage 126 on which a recording head 123 is mounted, moves along the recording material. The carriage 126 is movably guided and supported by guide rails 101*a* and 101*b* which are placed in a chassis 101 of an apparatus main body. A part of a timing belt 103 is coupled to the carriage 126. The carriage 126 reciprocates by drive force transmitted from a carriage motor 102 fixed to the chassis 101, through the timing belt 103.

On the base side of the apparatus main body, a recovery mechanism unit 108 is arranged at a position opposite the recording head 123 mounted on the carriage 126. A cap 104, with which a discharge port surface of the recording means is covered, is provided in the recovery mechanism unit 108. The cap 104 prevents the ink near the discharge port from adhering or thickening in a recording standby state. Also, the cap 104 sucks and recovers clogging of the discharge port by sucking that the ink from the discharge port by means of the negative pressure introduced from a negative-pressure generating source such as a pump. The cap 104 is made of a rubber material or the like having elasticity. The cap 104 is held by a cap holder 105. The cap holder 105 is mounted so as to be able to slide vertically with respect to a cap slider 106. A cap spring 107 is attached between the cap holder 105 and the cap slider 106.

A shaft portion 106*a* of the cap slider 106 is movably guided and supported along a cam surface (shown by broken lines) provided in a base portion of the apparatus main body. An abutting surface 106*b* which can abut onto a side face of the carriage 126 is provided in the cap slider 106. After the carriage 126 makes an entry into the recovery mechanism unit 108 to abut onto the abutting surface 106*b*, the cap slider 106 can follow the movement of the carriage 126. A lock lever 111 which fixes the cap slider at a predetermined position is attached to the cap slider 106. A lock lever spring 109 is provided between an end portion of the lock lever 111 and the apparatus main body side. When the carriage 126 is not located at the recovery mechanism unit 108, the cap slider 106 is held at a predetermined standby position by an action of the lock lever spring 109.

In the recovery mechanism unit 108 having the above-described configuration, when the carriage 126 makes the entry into the recovery mechanism unit, the side face of the carriage 126 abuts on the abutting surface 106*b* of the cap slider 106, which allows the cap slider 106 to follow the movement of the carriage 126 to be moved (slid). When the carriage 126 further makes the entry into a deeper portion of the recovery mechanism unit 108, the cap slider 106 is gradually lifted to the recording means side by the action of the cam surface (shown by broken line) on the apparatus main body side. Therefore, the cap 104 abuts onto the discharge port surface of the recording head 123, and the cap becomes a capping state. In the capping state, the cap 104 closely contacts the discharge port surface of the recording head by the action of spring pressure of the cap spring 107. Thus, the cap is in the standby state while being in the capping state, which allows the discharge ports and the discharge port surface of the recording head 123 to be protected.

One end of a suction tube 110 is connected to the cap 104 through the cap holder 105, and the other end of the suction tube 110 is connected to a suction pump. Accordingly, the ink can be sucked by the negative pressure generated in the cap 104 by operating the suction pump while the cap is in the capping state. The ink suction is a suction recovery process of eliminating the clogging of the discharge port, and the ink suction is one of main functions of the recovery mechanism unit 108.

When the moving direction of the carriage 126 is reversed to be moved in the direction in which the carriage 126 retracts from the recovery mechanism unit 108, the cap 104 retracts gradually from the discharge port surface to become an opened state, while the cap slider 106 is moved in synchronization with the carriage 126. Before the carriage 126 starts its reverse movement, the lock lever 111 is subject to a clockwise torque about a shaft 106*a* of the cap slider 106 by the action of the lock lever spring 109, so that a leading end of the lock lever is latched at the position shown in FIG. 14 fixing/latching portion, and the lock lever 111 is held and stopped at the position. When the carriage 126 is further moved in the direction in which the carriage 126 retracts while the lock lever 111 is latched, the cap slider 106 whose shaft 106*a* holds the lock lever 111 is also held by the apparatus main body side to release the synchronous movement between the cap slider 106 and the carriage 126, which allows only the carriage 126 to start the movement toward a recording area.

A wiper 112 which wipes the discharge port surface 125 is mounted on the cap slider 106. In the state shown in FIG. 14, the leading end of the wiper 112 is arranged at the position where the wiper 112 comes into contact with the discharge port surface 125. Therefore, when the carriage 126 is further moved in the direction in which the carriage 126 retracts, each discharge port array provided in the discharge port surface 125 is sequentially wiped by the wiper 112, which allows the foreign matters such as the adhesive ink near the discharge port to be removed. The wiper 112 is formed by a plate-shaped member made of a rubber material or the like having elasticity. When the carriage 126 is moved to the position where the wiper 112 ends the wiping, a releasing portion 126*a* provided in the carriage abuts onto the leading end of the lock lever 111 to push down the lock lever in the counterclockwise direction, which releases the latching between the lock lever 111 and the latching portion of the base portion. Then, spring force of the lock lever spring 109 acts on the cap slider 106 again, and the cap slider 106 is held after the cap slider 106 is moved to the standby position shown in FIG. 12.

U.S. Pat. No. 6,109,725 discloses a mechanism, in which a wiper holder for holding the wiper is attached while one end of the wiper holder acts as a rotating axis, the other end being urged by the spring, and the carriage abuts onto the wiper holder to keep an insertion amount (overlap amount, interference depth) of the wiper constant with respect to the discharge port surface.

In the configuration shown in FIGS. 3 and 11 of Japanese Patent Application Laid-Open No. 2000-15832, when the carriage is moved to the recovery mechanism unit, the wiper holder is moved in the direction in which the wiper holder enters the discharge port surface by the followed movement of the cap slider. Then, an abutting portion provided in the cap holder abuts onto the carriage to keep the insertion amount of the wiper constant during the wiping. Thus, the process of cleaning the recording head can be performed by the movement of the carriage and the action of the recovery mechanism unit.

However, in the above-described conventional techniques, when an unavoidable convex part (protrusion part) or a concave part is formed at the end portion of each discharge port array in the recording means due to a production method or an internal structure, the wiper runs on the convex part or the wiper is hooked on the concave part, which results in problems in that wiping performance is decreased and the cleaning cannot sufficiently be performed.

FIG. 15 is a front view showing a relative positional relationship between the wiper and the recording means when the recording mechanism unit (carriage unit) is obliquely held in the conventional inkjet recording apparatus. FIG. 16 is an explanatory view illustrating each discharge port array of the recording means and a wiper configuration and arrangement when the wiper wipes respective discharge port arrays and the convex parts of the discharge port arrays. FIGS. 17A and 17B are explanatory views showing the state in which the wiping is performed while the wiper avoids the convex parts of a color discharge port unit in the discharge port surface of the recording means. Referring to FIGS. 16, 17A and 17B, the wiping action in the case where the convex parts exist on the discharge port surface of the recording means will be described below. In FIGS. 15, 16, 17A and 17B, color discharge port arrays 123*a* and a black discharge port array 123*b* are formed in the discharge port surface 125 of the recording head 123, and convex parts 128 are formed at end portions of the discharge port arrays 123*a* and 123*b* due to the production method. As shown in FIG. 16, wipers 112*a* and 112*b* which correspond to the discharge port arrays 123*a* and 123*b* are provided in the recovery mechanism unit.

The color discharge port away 123*a* will mainly be described. As shown in FIGS. 17A and 17B, notches are provided in the wiper 112*a* so as to avoid the convex parts 128. This is because, as shown in FIG. 17B, when the wiper 112*a* runs on the convex part 128, a space (gap) is generated between the discharge port surface and the wiper 112*a*, hindering appropriate wiping. In the recording head 123, it is necessary that the relative position between the discharge port surface and the wiper 112*a* is corrected with high accuracy in order that a wiping portion of the wiper 112*a* does not run on the convex parts 128 and the whole area of the discharge port array 123*a* can securely be wiped. However, in the conventional wiping mechanism shown in FIGS. 12 to 14, the relative positional relationship between the carriage 126 including the recording means and the wiper 112 depends on a size and assembly accuracy of each component in all the directions. Therefore, in order that the wiper 112*a* securely wipes the whole area of the discharge port away 123*a* without running on the convex part 128 of the discharge port surface, it is necessary to improve the accuracy of each component, which increases the cost.

In the configuration disclosed in U.S. Pat. No. 6,109,725, when the position of the recording head fluctuates in a sheet thickness direction, parallelism cannot be maintained at a contact surface between the wiper 112 and the discharge port surface of the recording head 123. Further, in the recording apparatus having a sheet-gap adjusting mechanism in which a distance between the recording head 123 and the recording sheet is changed by tilting the carriage with respect to a guide rail bib, the parallelism cannot be maintained at the contact surface either. When the convex part 128 is formed on the discharge port surface of the recording head, the wiper 112 runs on the convex part 128, so that the discharge port surface of the recording head 123 cannot sufficiently be wiped. In the configuration disclosed in Japanese Patent Application Laid-Open No. 2000-15832, the relative position between the recording head and the wiper is uniformly controlled only in the wiper insertion amount direction, and the relative position in the array direction of the discharge port away depends on the component accuracy and the attachment accuracy. Accordingly, the decrease in assembly accuracy cannot be avoided because of an accumulative error of the component accuracy, and the cost is remarkably increased when the decrease in assembly accuracy is improved.

SUMMARY OF THE INVENTION

The invention can provide an inkjet recording apparatus with a simple and inexpensive configuration, in which the relative position between recording means and a wiper can be accurately controlled at an appropriate position when a discharge port surface is wiped. For example, the inkjet recording apparatus according to the invention can securely perform the wiping, even when a convex part is formed on the discharge port surface.

The invention can also provide an inkjet recording apparatus which discharges ink to perform recording on a recording material, the inkjet recording apparatus including: a recording mechanism unit mounting thereon recording means which is moved; a slide member which can be moved by following the movement of the recording mechanism unit; a wiper which wipes a discharge port surface of the recording means; and a wiper holder which holds the wiper, the wiper holder being mounted on the slide member so as to be displaceable in a direction intersecting the discharge port surface, wherein a relative position between the wiper and the discharge port surface is positioned in the direction intersecting the discharge port surface.

DETAILED DESCRIPTION OF THE PREFERRED EMBODIMENTS

Figure 1:
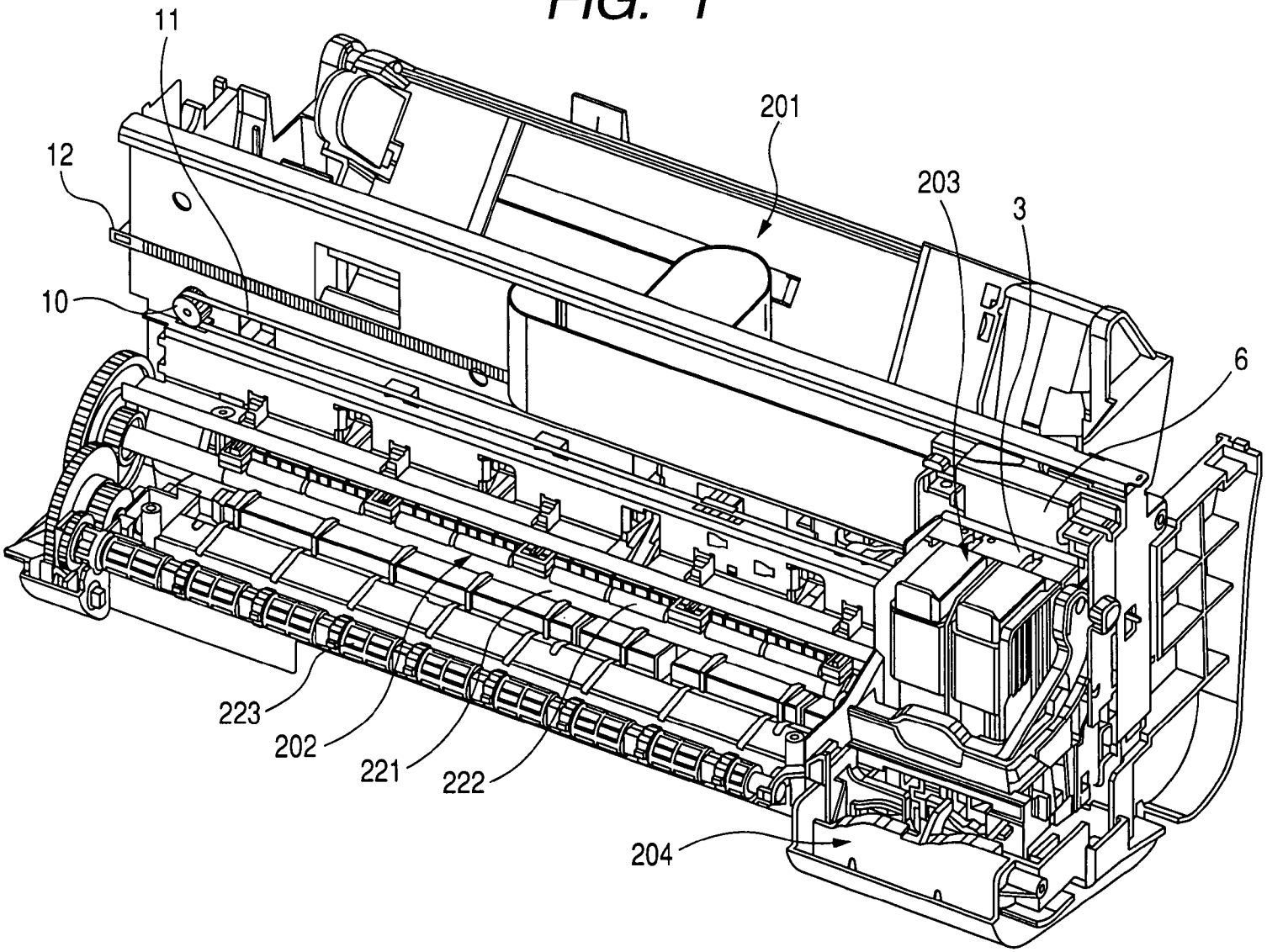
FIG. 1 is a perspective view showing an inkjet recording apparatus according to an embodiment of the invention.

Referring to the drawings, a preferred embodiment of the invention will be described below. In all the drawings, the same reference numerals indicate the same part or the corresponding part. FIG. 1 is a perspective view showing an inkjet recording apparatus according to an embodiment of the invention. The inkjet recording apparatus shown in FIG. 1 includes a sheet supply unit 201, a conveying unit 202, a recording mechanism unit (carriage unit) 203, and a recovery mechanism unit (cleaning mechanism unit) 204. The sheet supply unit 201 supplies the recording material such as a recording sheet to an apparatus main body. The conveying unit 202 conveys the recording material through the apparatus main body (recording portion and the like). The recording mechanism unit 203 records an image on the recording material based on image information. The recovery mechanism unit 204 maintains and recovers quality of the image formed by the recording mechanism unit 203.

The recording materials loaded on the sheet supply unit 201 are separated and supplied one by one by a sheet supply roller driven by a sheet supply motor, and the recording material is delivered to the conveying unit 202. The recording material delivered to the conveying unit 202 is conveyed between a conveying roller 221 and a pinch roller 222 through a recording portion. The conveying roller 221 is driven by a conveying motor and the pinch roller 222 is pressed against the conveying roller 221. While passing through the recording portion, the image is recorded on the recording material by the recording mechanism unit 203. The recording material on which the image is recorded is discharged to the outside of the apparatus main body by a sheet discharge roller 223 and a star gear. The sheet discharge roller 223 is driven in synchronization with the conveying roller 221, and the spur cooperates with the sheet discharge roller.

The recording mechanism unit 203 includes a carriage 6 and recording means 3 mounted on the carriage. The carriage 6 is guided and supported in the apparatus main body so as to reciprocately move in a main scan direction. Namely, the carriage 6 on which the recording means 3 is mounted is guided and supported so as to reciprocately move along a guide rail placed in the apparatus main body. The carriage 6 reciprocates along the guide rail by drive force of a carriage motor transmitted through a carriage belt 224. The recording of one line is performed by driving the recording means 3 in synchronization with the movement of the carriage 6. After the recording of one line, the recording material is conveyed by a predetermined pitch, and then this operation is repeated to perform the recording on the whole of the recording material.

The recovery mechanism unit (cleaning mechanism unit) 204 eliminates the clogging of the recording means 3 and the like to maintain and recover the recording quality in good condition. The recovery mechanism unit 204 includes pumping means, capping means, and wiping means. The pumping means sucks and discharges ink from a discharge port. The discharge ports are covered with the capping means. The wiping means cleans the discharge port surface by wiping the discharge port surface. The recording means 3 is inkjet recording means for utilizing thermal energy to discharge the ink, and the recording means 3 has an electrothermal conversion element which generates the thermal energy. In the recording means 3, film boiling is generated in the ink by the thermal energy applied by the electrothermal conversion element, and the ink is discharged from the discharge port to perform the recording by utilizing pressure change due to growth and compression of bubbles created during the film boiling. The electrothermal conversion element is arranged corresponding to each of the plural discharge ports. A pulse voltage is applied to the corresponding electrothermal conversion element according to recording information (recording signal), thereby discharging the ink from the discharge port.

Figure 2:
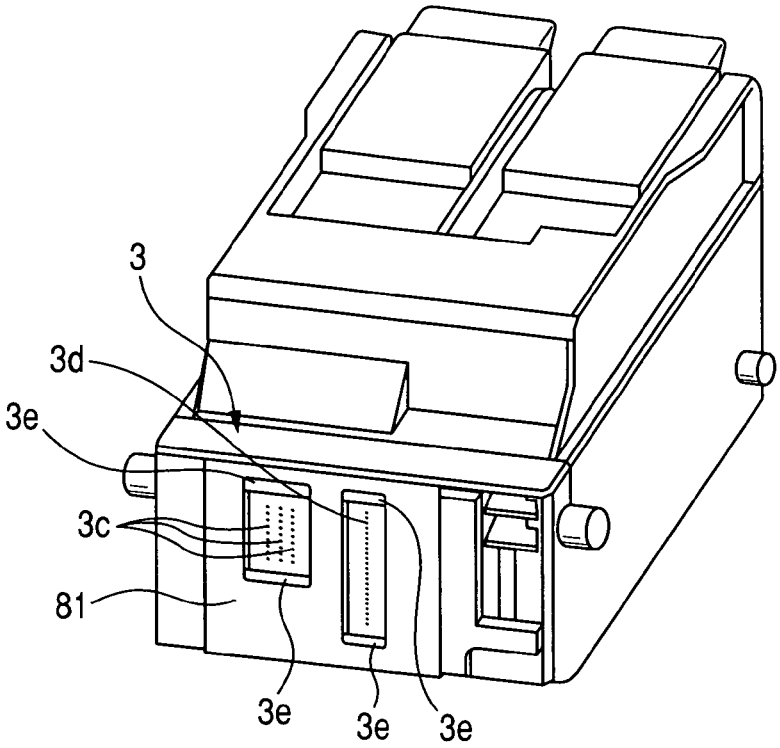
FIG. 2 is a perspective view showing recording means when viewed from a discharge port surface side.

FIG. 2 is a perspective view showing the recording means 3 when viewed from the discharge port surface side. A color (for example, cyan, magenta, and yellow) discharge port array 3*c* and a black discharge port array 3*d* are formed in a discharge port surface 81 of the recording means 3 according to the embodiment. In the discharge port surface 81 which faces the recording material such as the recording sheet separately from the recording material at a predetermined distance (for example, about 0.2 mm to about 2.0 mm), the plural discharge port arrays 3*c* and 3*d* in which the plural discharge ports are arranged at predetermined pitches are formed, and the electrothermal conversion element (a heating resistor and the like) which generates the ink discharge energy is arranged along a wall surface of each liquid path communicating a common liquid chamber and each discharge port. The recording means 3 is mounted on the carriage 6 in a positional relationship in which the discharge ports are arranged in a direction orthogonal to a main scan direction (moving direction of the carriage 6). Thus, the corresponding electrothermal conversion element is driven based on an image signal or a discharge signal, the film boiling is generated in the ink in the liquid path, and an ink droplet is discharged from the discharge port by the pressure generated during the film boiling.

Figure 3:
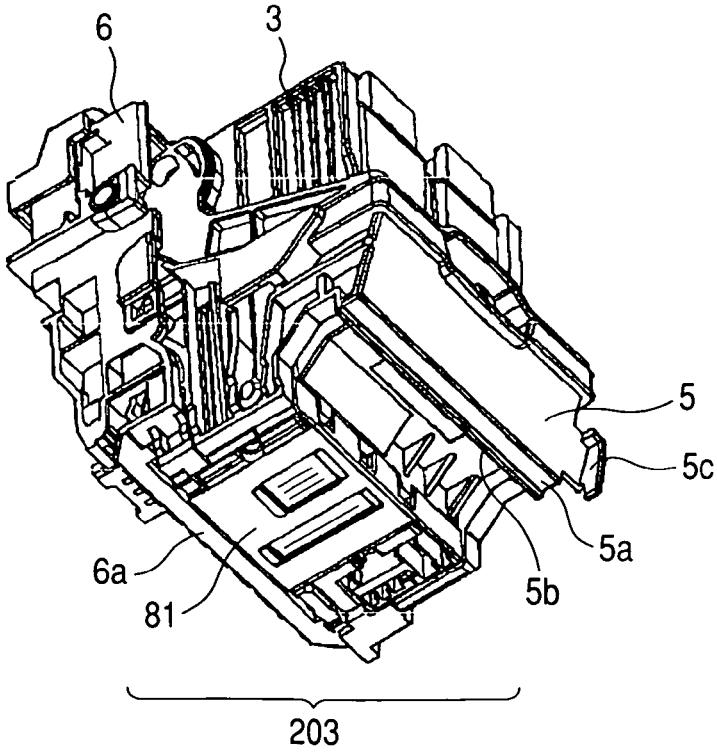
FIG. 3 is a perspective view showing a recording mechanism unit in which the recording means is mounted on a carriage when viewed from the discharge port surface side.
Figure 4:
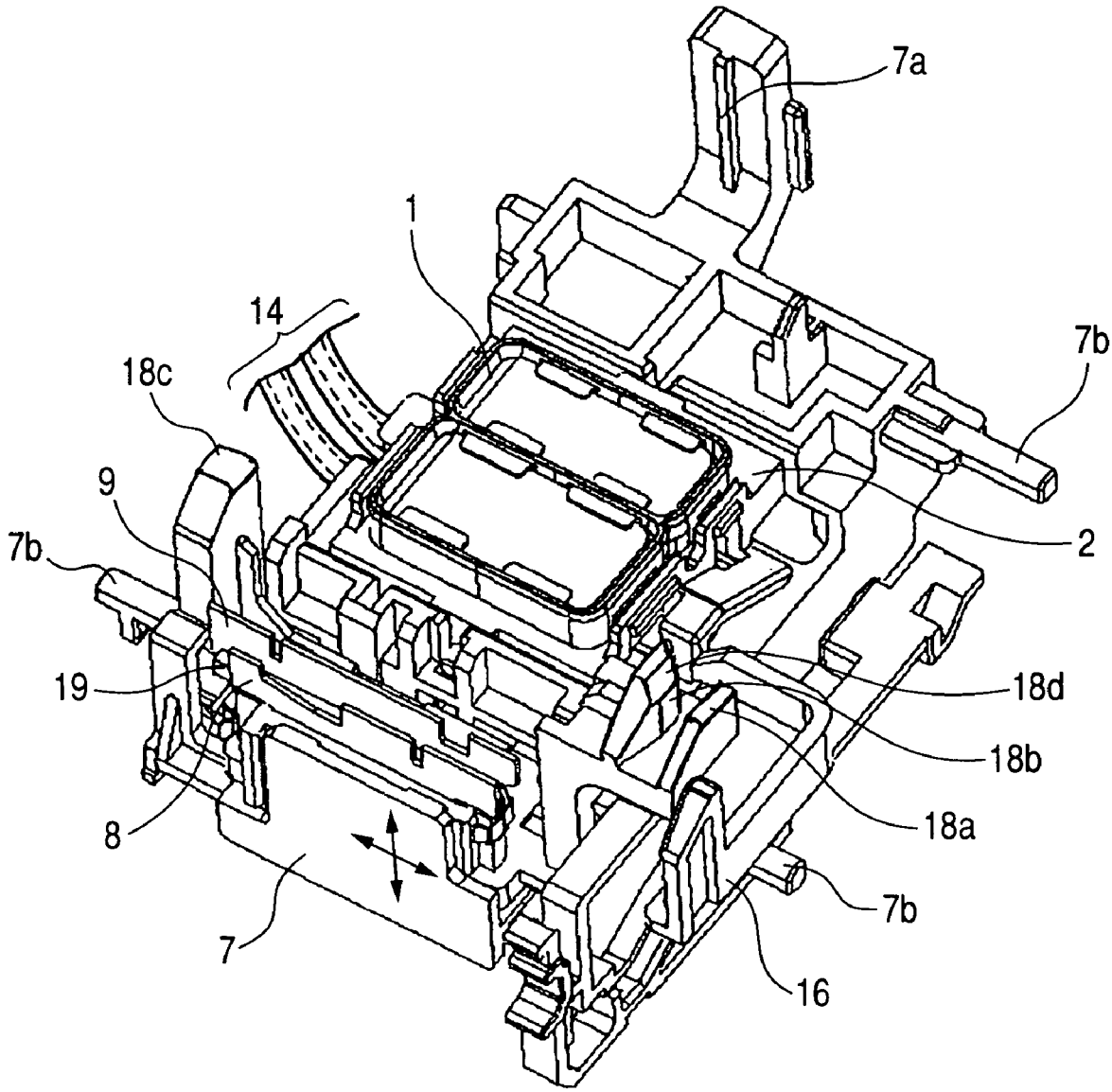
FIG. 4 is a perspective view showing a state in which a cap and wipers are incorporated into a slide member of the inkjet recording apparatus of the invention.
Figure 5:
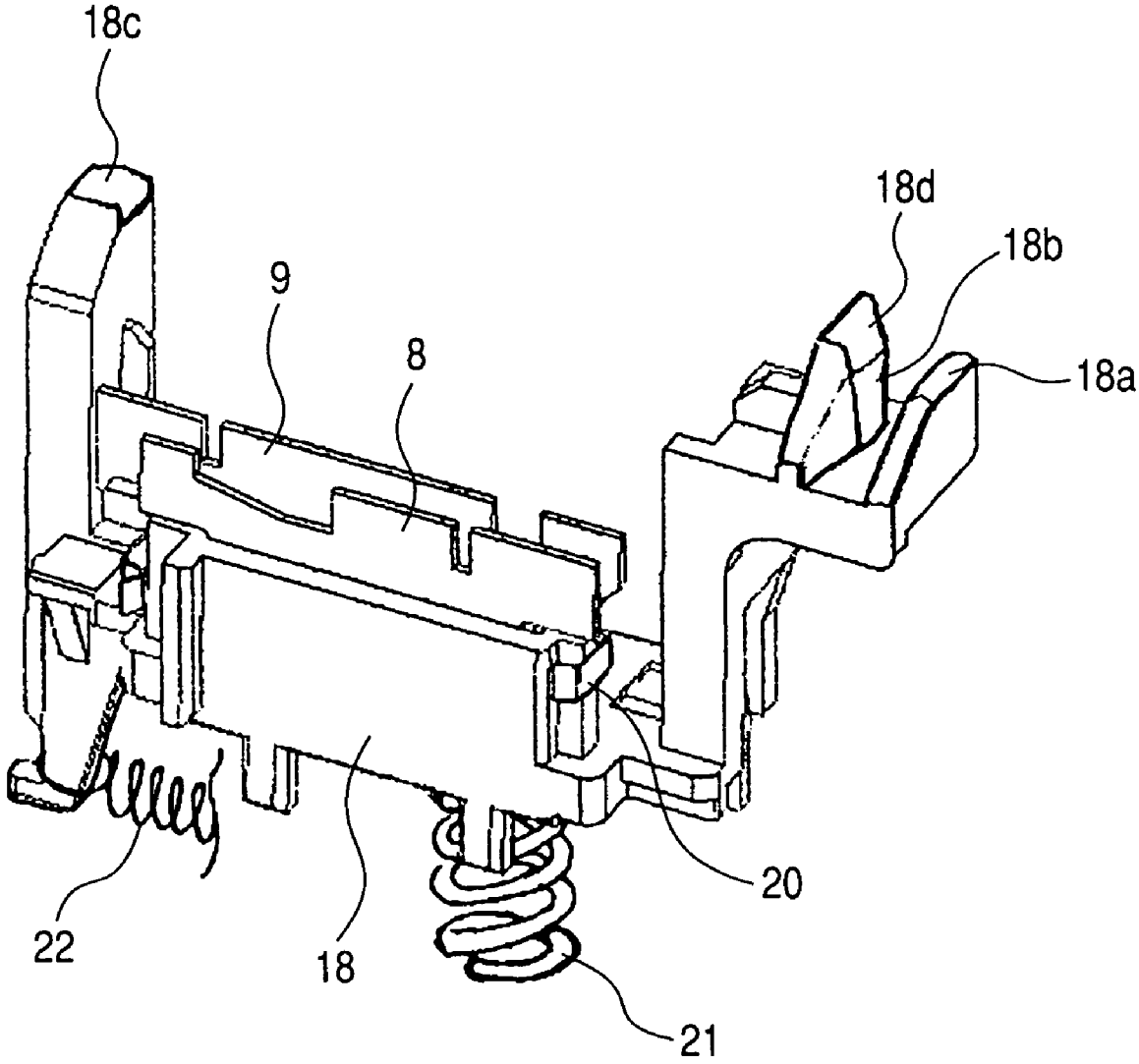
FIG. 5 is a perspective view showing a wiper holder shown in FIG. 4 when viewed from the outside.

FIG. 3 is a perspective view showing the recording mechanism unit 203 in which the recording means 3 is mounted on the carriage 6 when viewed from the discharge port surface side of the recording means. FIG. 4 is a perspective view showing a state in which a cap 1, wipers 8 and 9, and the like are incorporated into a slide member 7 in the inkjet recording apparatus of the invention. FIG. 5 is a perspective view showing a wiper holder 18 to which the wipers 8 and 9 are attached when viewed from the outside.

In FIG. 4, a cap holder 2 to which the cap 1 is fixed is held while being able to be vertically moved with respect to the slide member 7 by a cap spring 4. The cap holder 2 is connected to one end of a suction tube 14 communicated with the inside of the cap 1, and the other end of the suction tube 14 is connected to a pump which serves as a negative pressure generating source. When the pump is operated while the recording means 3 is capped with the cap 1, the negative pressure is introduced into the cap 1 through the suction tube 14, which allows the ink to be sucked from the discharge ports of the recording means 3. The wiper holder 18 is held at one end of the slide member 7 while being urged upward by a wiper holder spring 21. The wiper holder 18 is also held while the wipers 8 and 9 are displaceable in a longitudinal direction with respect to the slide member 7 by a wiper holder slide spring 22. In the wiper holder 18, the color wiper 8 and the black wiper 9 are fixedly positioned through a spacer 19 by a stopper 20.

Figure 6:
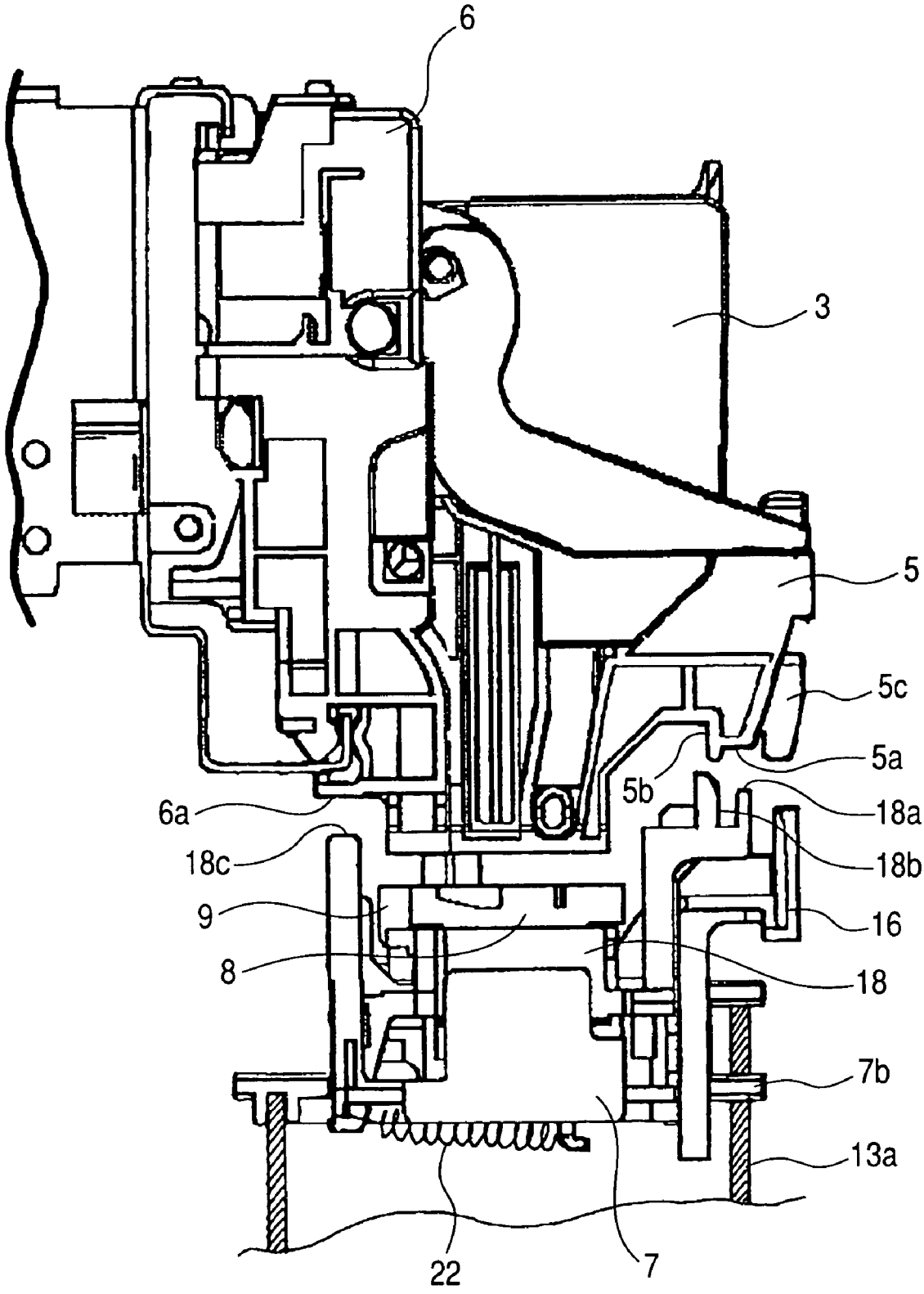
FIG. 6 is a side view showing a positional relationship between the slide member and the carriage when the slide member is located at a standby position in a recovery mechanism unit of the invention.
Figure 7:
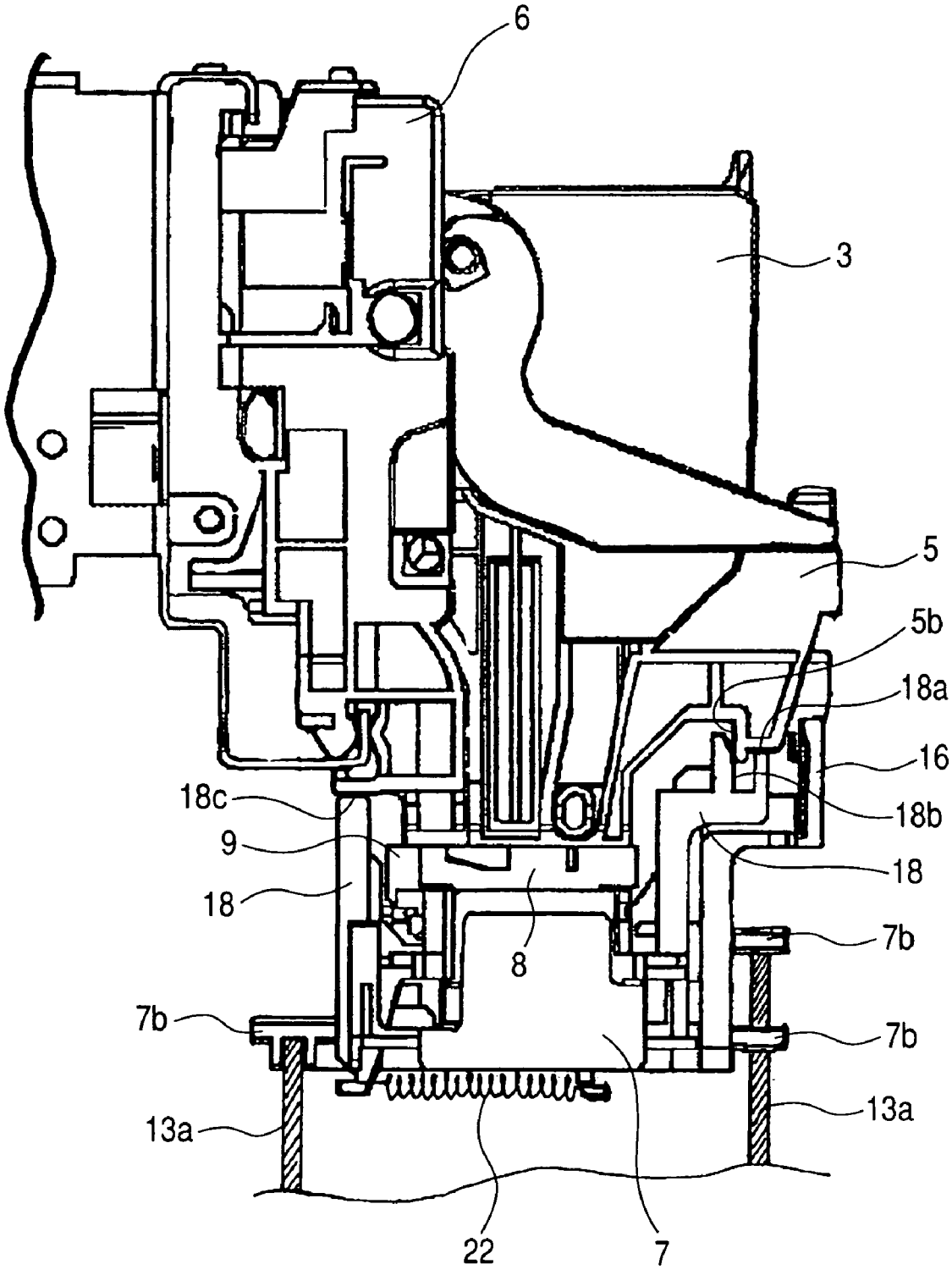
FIG. 7 is a side view showing a positional relationship between the slide member and the carriage when the slide member is located at a wiping position in the recovery mechanism unit shown in FIG. 6.
Figure 8:
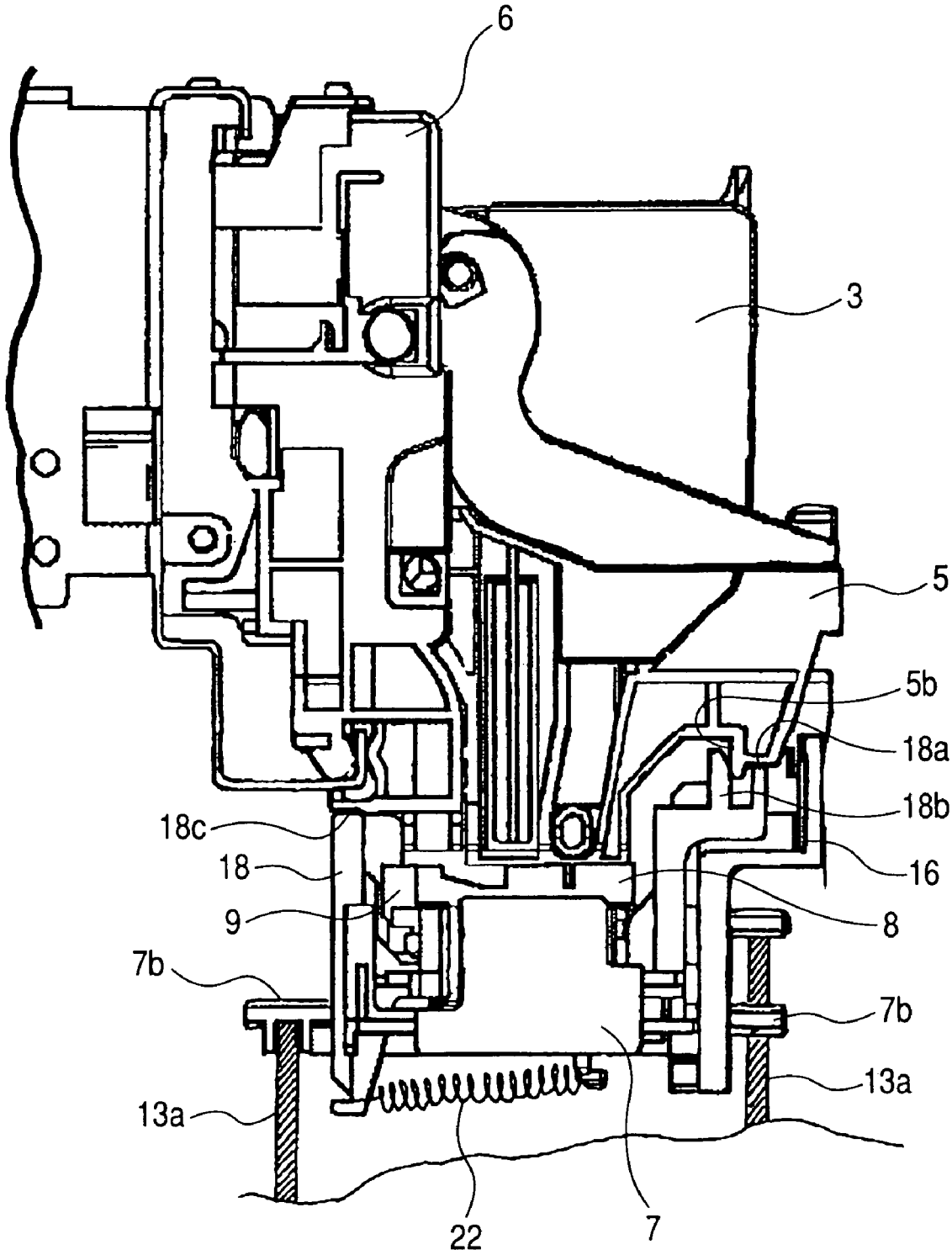
FIG. 8 is a side view showing a positional relationship between the slide member and the carriage when the slide member is pushed into the deeper side from the capping position in the recovery mechanism unit shown in FIG. 6.
Figure 9:
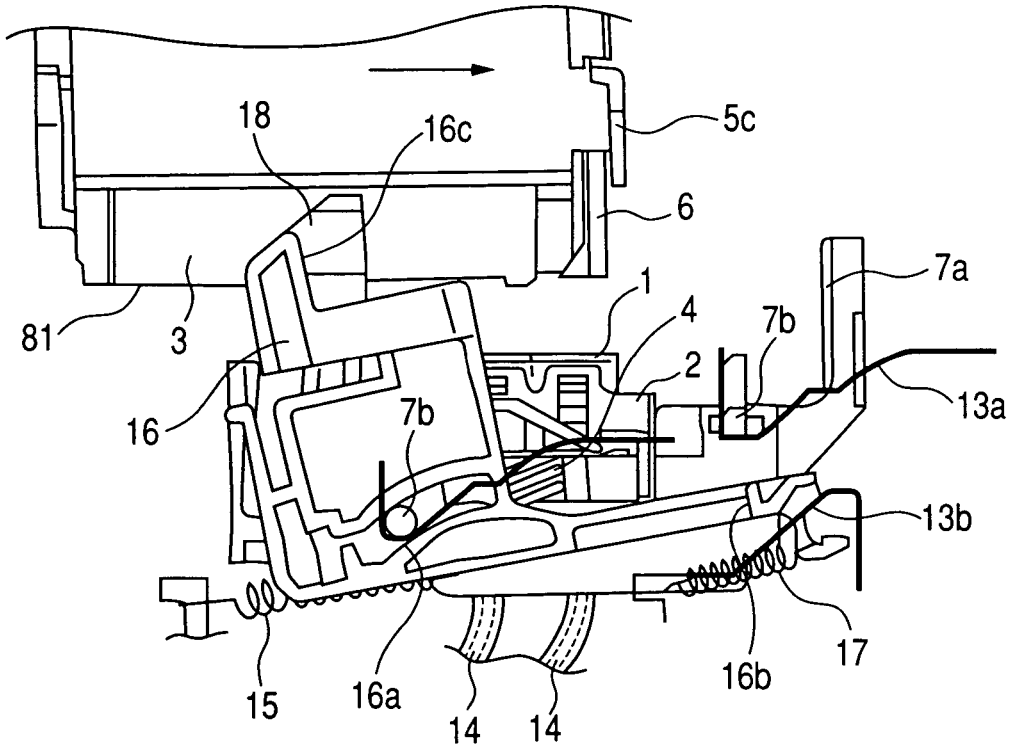
FIG. 9 is a front view showing a positional relationship between the slide member and the carriage when the slide member is located at the standby position in the recovery mechanism unit of the invention.
Figure 10:
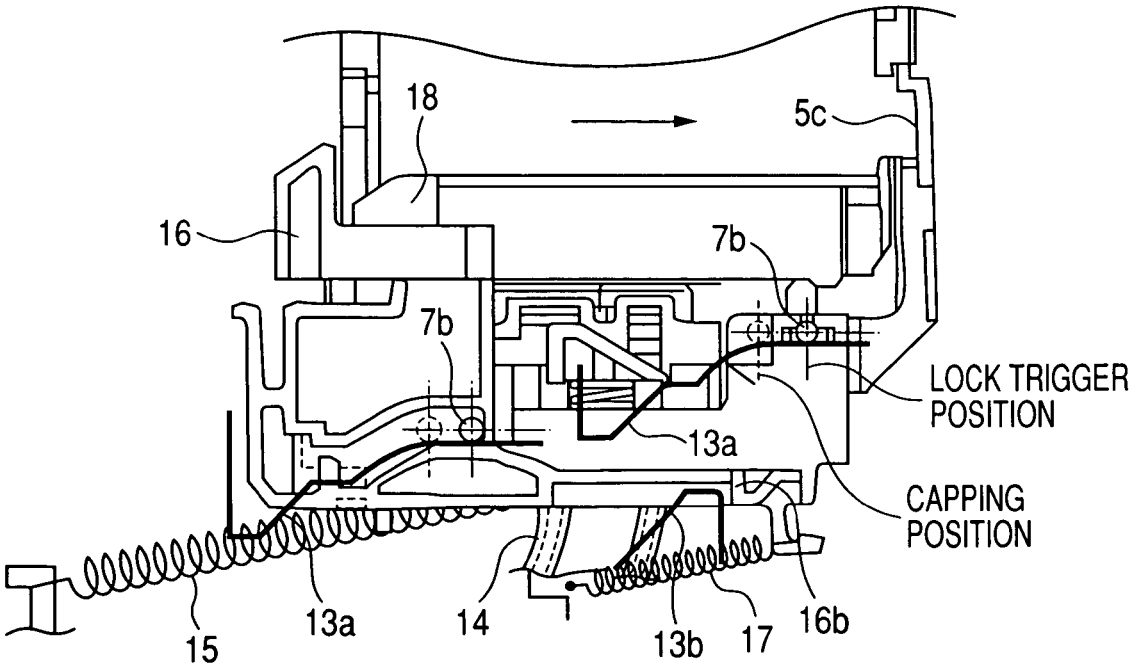
FIG. 10 is a front view showing a positional relationship between the slide member and the carriage when the slide member is pushed into a lock trigger position in the recovery mechanism unit shown in FIG. 9.
Figure 11:
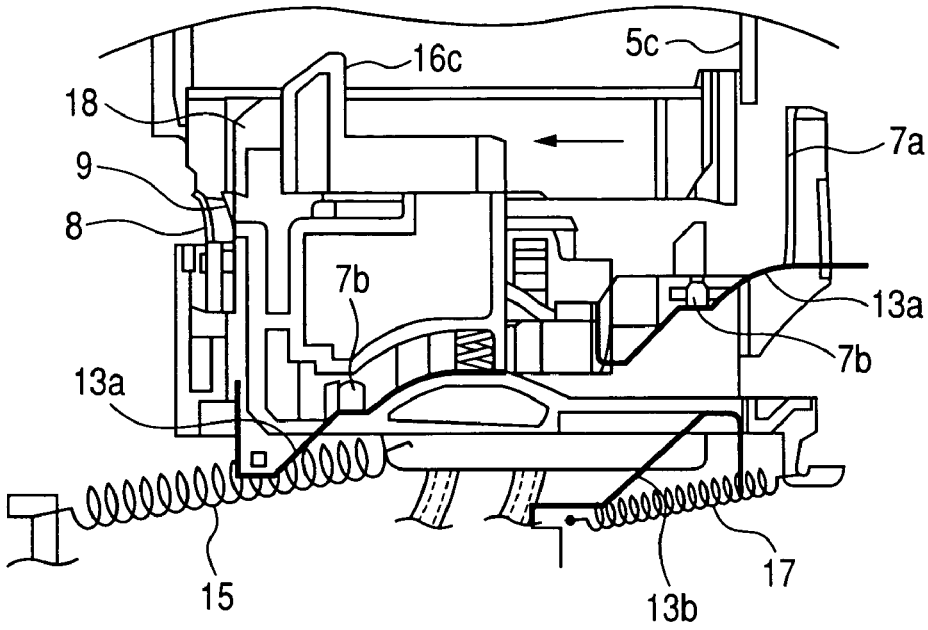
FIG. 11 is a front view showing a positional relationship between the slide member and the carriage when the slide member is fixed to a base portion by a lock lever to start separation from the carriage in the recovery mechanism unit shown in FIG. 9.
Figure 12:
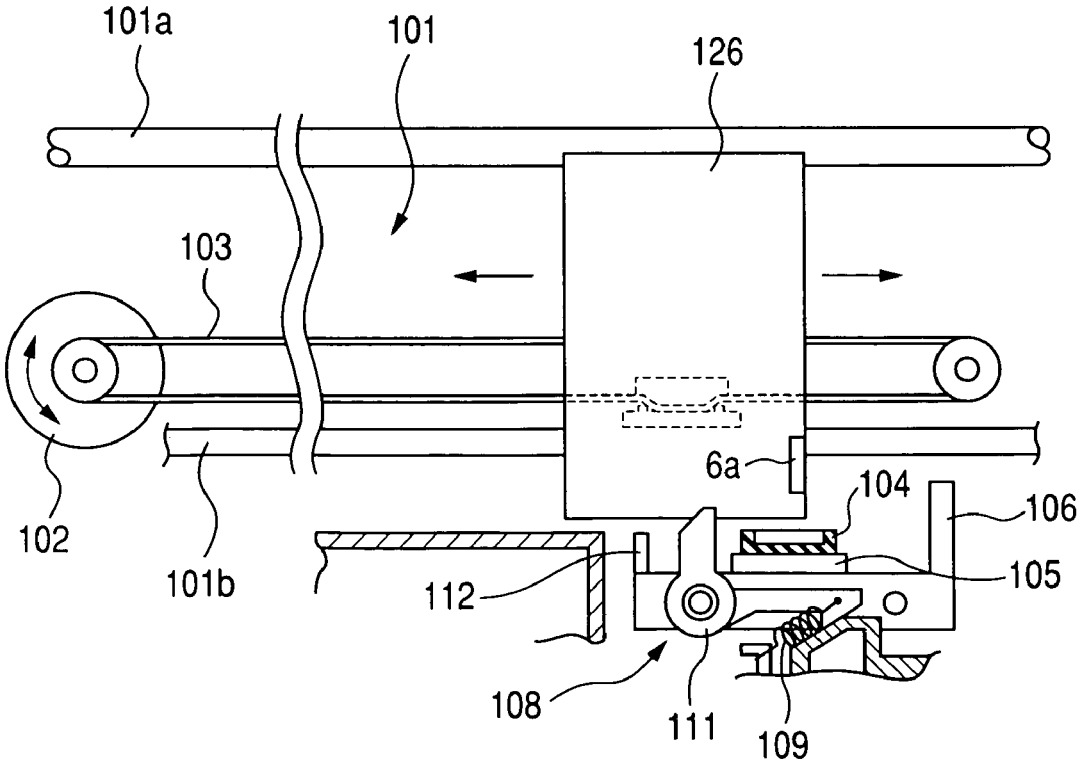
FIG. 12 is a front view showing the conventional recovery mechanism unit where a cap is opened.
Figure 13:
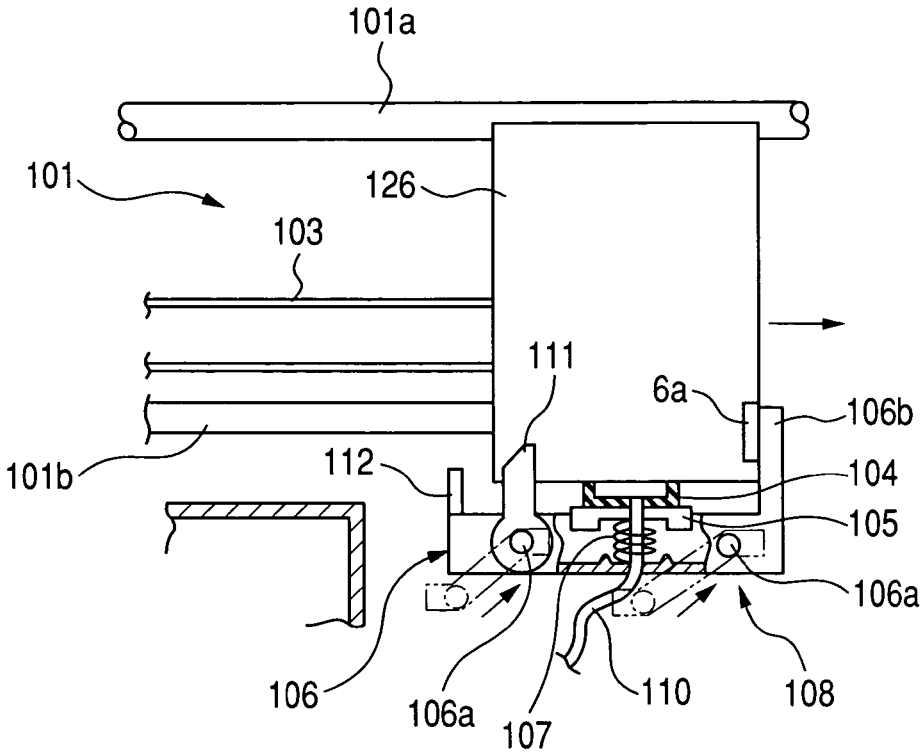
FIG. 13 is a front view showing the conventional recovery mechanism unit shown in FIG. 12 while the capping state is partially broken away.

FIG. 6 is a side view showing the positional relationship between the slide member 7 and the carriage when the slide member 7 is located at a standby position in the recovery mechanism unit of the invention. FIG. 7 is a side view showing the positional relationship between the slide member and the carriage when the slide member is located at a wiping position in the recovery mechanism unit shown in FIG. 6. FIG. 8 is a side view showing the positional relationship between the slide member and the carriage when the slide member is pushed into the deeper side from the capping position in the recovery mechanism unit shown in FIG. 6. FIG. 9 is a front view showing the positional relationship between the slide member and the carriage when the slide member is located at the standby position in the recovery mechanism unit of the invention when viewed from the recording apparatus front side. FIG. 10 is a front view showing the positional relationship between the slide member and the carriage when the slide member is pushed into a lock trigger position by the carriage in the recovery mechanism unit shown in FIG. 9 when viewed from the recording apparatus front side. FIG. 11 is a front view showing the positional relationship between the slide member and the carriage when the slide member is fixed to a base portion 13 by a lock lever to start separation from the carriage in the recovery mechanism unit shown in FIG. 9 when viewed form the recording apparatus front side.

In FIGS. 6 to 11, the slide member 7 is connected (coupled) to a base portion 13 of the apparatus main body by a slider spring 15. Projections (shaft portions) 7*b* are provided at four points in a side face of the slide member 7. The projections 7*b* are projected in a rod shape. The projections 7*b* are placed (abut) onto slide member control cam surfaces 13*a* and 13*b* provided on the base portion 13. While the projections 7*b* abut onto the cam surfaces 13*a* and 13*b* by the slider spring 15 to control the vertical position of the slide member 7 along the cam surfaces 13*a* and 13*b*, the slide member 7 is movable in the carriage moving direction. Concave portions (groove portions) are formed in the leading end portion of some of the four projections 7*b* (in the drawings, two projections on the upstream side in the recording material conveying direction). The concave portions position the slide member 7 in the discharge port array direction by catching rib portions forming the cam surfaces 13*a* and 13*b* of the base portion 13.

An abutting portion 7*a* is provided in the slide member 7. The carriage 6 (or recording means 3) which makes the entry into the recovery mechanism unit 204 abuts onto the abutting portion 7*a*. When the carriage 6 is moved and the side face of the carriage 6 abuts onto the abutting portion 7*a*, the slide member 7 is allowed to be moved by following the movement of the carriage 6 entering into the recovery mechanism unit 204. A lock lever 16 is incorporated into the slide member 7. The lock lever 16 is incorporated so as to be slidable in the carriage moving direction with respect to one of the four projections 7*b*. One end of the lock lever 16 is connected (coupled) to the base portion 13 by the lock lever spring 17. A cam portion 13*b* is provided in the base portion 13. The cam portion 13*b* can abut onto (engage with) a cam surface 16*b* formed at one end of the lock lever 16.

Thus, the lock lever 16 is held while caught between the slide member 7 and the base portion 13 of the recording apparatus. The detail action of the lock lever 16 will be described later. In FIG. 3, a carriage cover 5 is fixedly attached to the carriage 6. The carriage cover 5 holds the recording means 3 while protecting a carriage board (not shown) and the like. In the carriage 6 and the carriage cover 5, abutting portions (slide surfaces) 5*a*, 5*b*, and 6*a* are provided over the moving direction of the carriage 6. The abutting portions 5*a*, 5*b*, and 6*a* can slidably abut onto abutting portions (abutting surfaces) 18*a*, 18*b*, and 18*c* of the wiper holder 18.

The specific wiping action of the recovery mechanism unit 204 in the embodiment will be described next. When the carriage 6 and the recording means 3 are located at a position where the carriage 6 and the recording means 3 do not make the entry into the recovery mechanism unit 204 (for example, the position shown in FIG. 9), the carriage 6, the recording means 3, and the wipers 8 and 9 are separated from one another with predetermined clearances in the vertical direction, and the carriage 6, the recording means 3, and the wipers 8 and 9 never abut onto one another. FIG. 6 shows this state when viewed from the direction (from left side of the recording apparatus) intersecting the discharge port array of the recording means. In order to perform the wiping action to the recording means 3 by moving the carriage 6 from the state shown in FIG. 6, the carriage 6 starts to be gradually moved toward the recovery mechanism unit 204 side.

As shown in FIG. 9, when the carriage 6 makes the entry into the recovery mechanism unit 204 in order to perform the recovery process (cleaning action) of the recording means 3, the slide member 7 starts the movement by following the movement of the carriage 6 from the position where the side face of the carriage 6 starts to abut onto the abutting portion 7*a* of the slide member 7. As shown in FIG. 10, when the slide member 7 starts the followed movement, the whole of the slide member 7 is gradually moved upward toward the recording means 3 while moving rightward in FIG. 10 along the slide member control cam surface 13*a* provided in the base portion 13.

When the slide member 7 is moved, the lock lever 16 incorporated into the projection 7*b* of the slide member 7 follows the movement of the slide member 7 to start the movement from the position where the projection 7*b* starts to abut onto the side face of a cam-shaped notch groove 16*a* provided in the lock lever 16 (FIG. 10). Namely, the lock lever 16 starts the synchronous movement by the action of the notch groove 16*a* with slight time difference from the movement of the slide member 7. In addition to the cam surface 13*a* on which the projection 7*b* of the slide member 7 slides, the cam portion 13*b* for the lock lever 16 is also provided in the base portion 13 of the recording apparatus.

The leading end of the lock lever 16 is coupled to a spring peg portion of the base portion 13 through the lock lever spring 17. Accordingly, predetermined urging force is imparted to the lock lever 16 in the counterclockwise direction in FIG. 10 about the coupled projection 7*b*, which allows the cam portion 16*b* at the leading end of the lock lever 16 to be moved in the moving direction of the carriage 6 while always abutting on the cam portion 13*b*. At this point, the wipers 8 and 9 are separated by a fixed distance from the carriage 6 in the main scan direction, and the carriage 6 never comes into contact with the wipers 8 and 9 in the capping state.

When the carriage 6 is moved to the capping position shown in FIGS. 7 and 10, in the wiper holder 18, the abutting surface 18*a* comes into contact with the slide surface 5*a* of the carriage cover, and the abutting surface 18*c* comes into contact with the slide surface 6*a* of the carriage 6. Therefore, the wiper holder 18 is pushed in the opposite direction (downward in the drawings) to the urging force of the wiper holder spring 21. As the carriage 6 is moved toward the recovery mechanism unit 204, an incline surface 18*d* of the wiper holder 18 gradually abuts on a region of the carriage cover 5, which allows the wiper holder 18 to be moved toward the upstream side in the conveying direction of the recording apparatus. At the capping position shown in FIG. 10, the slide surface 5*b* of the carriage cover 5 abuts onto the abutting surface 18*b* of the wiper holder 18 while being pressed against each other. Therefore, the relative position between the wipers 8 and 9 and the recording means 3 is positioned in the direction (discharge port array direction) intersecting the carriage moving direction.

When the carriage 6 starts to be further moved into the deeper side (lock trigger position shown in FIG. 10) of the recovery mechanism unit 204 from the capping position, the projection 7*b* (left slider shaft portion 7*b* shown in FIG. 10 on the lock lever 16 side) of the slide member 7 abuts onto a stopper portion after the projection 7*b* is moved along the slide groove 16*a* of the lock lever 16. Then, the lock lever 16 is moved (slides) rightward in the drawing by following the slide member 7 against the lock lever spring 17 coupled between the leading end portion 16*b* of the lock lever 16 and the base portion 13. The cam surface 16*b* provided at the leading end portion engages with the cam portion 13*b*, after the cam surface 16*b* climbs over the cam portion 13*b* as shown in FIG. 10 by the movement of the lock lever 16. Accordingly, the action of the lock lever spring 17 fixes the lock lever 16 to the relative position shown in FIG. 11 with respect to the slide member 7.

Figure 14:
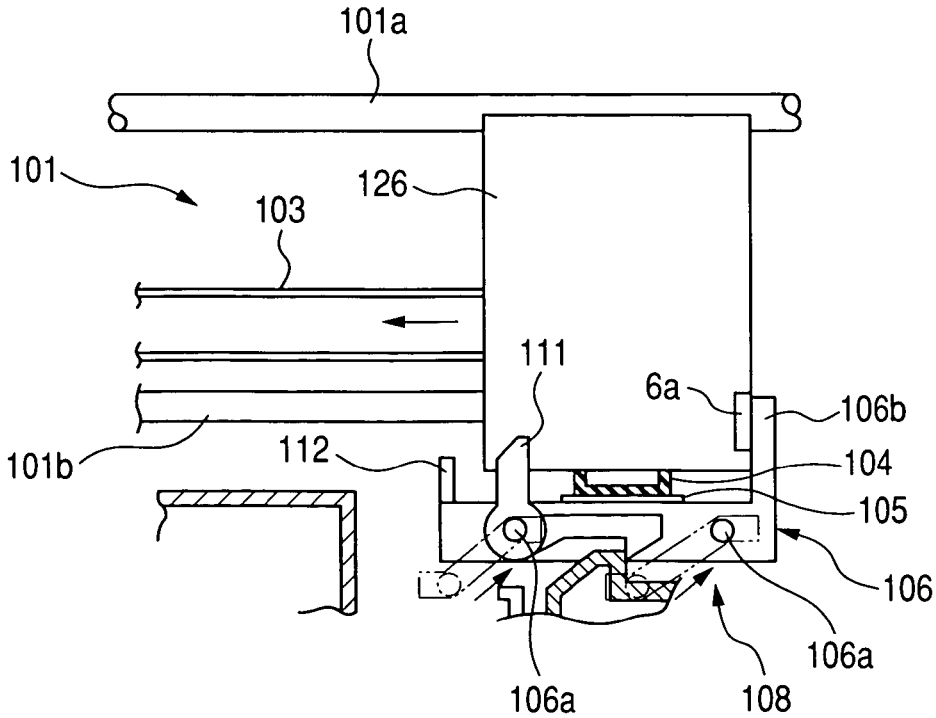
FIG. 14 a front view showing the conventional recovery mechanism unit shown in FIG. 12, where the slide member is fixed by the lock lever.

Then, the carriage 6 reverses its course at the deepest portion of the recovery mechanism unit 204 to start the movement toward the direction (leftward in FIG. 11) in which the carriage 6 retracts from the recovery mechanism unit 204, the slide member 7 follows the carriage 6 to be moved by the action of the slide member spring 15 and the projection 7*b* of the slide member 7 is moved leftward in the drawing along the cam surface 13*a*. When the carriage 6 is further moved toward the return direction, the slide member 7 is moved downward according to the shape of the cam surface 13*a*, which allows the lock lever 16 to be held in a state in which the lock lever 16 cannot be moved from the lock position by latching the cam portion 13*b* as shown in FIG. 14. Therefore, the projection 7*b* of the slide member 7 is held at a position in a midpoint of the cam surface 13*a* by the lock lever 16, and the slide member 7 starts the separation from the carriage 6 when the slide member 7 reaches this position.

When the separation between the slide member 7 and the carriage 6 is started, as shown in FIG. 7, because the abutting surfaces 18*a* and 18*c* of the wiper holder 18 still abut and slide on the slide surfaces 5*a* and 5*b* on the carriage 6 side, the relative position between the wipers 8 and 9 and the discharge port surface 81 is kept constant in the insertion amount direction. On the other hand, at this point, because the abutting surface 18*b* of the wiper holder 18 abuts onto the slide surface 5*b* on the carriage 6 side (carriage cover 5), the relative position between the wipers 8 and 9 and the discharge port surface 81 is also positioned at a predetermined correction positional relationship with respect to the direction of the discharge port arrays 3*c* and 3*d*. Namely, the positions of the wipers 8 and 9 are corrected at the optimum positions in which the wiping action is performed. When the carriage 6 is further moved toward the return direction (leftward in the drawings), the abutting surfaces 18*a*, 18*b*, and 18*c* of the wiper holder 18 slide onto the slide surfaces 5*a*, 5*b*, and 6*a* on the recording mechanism unit 203 side respectively while maintaining the relative position at the optimum state, and the discharge port arrays 3*c* and 3*d* in the discharge port surface 81 pass through the wipers 8 and 9.

Therefore, as shown in FIG. 14, the discharge port surface 81 is wiped by the wipers 8 and 9 under the optimum conditions, and the foreign matters such as the ink and dust adhering to the discharge port surface 81 near the discharge port arrays 3*c* and 3*d* after the suction recovery process and the like are removed. The wiper holder 18 of the embodiment acts on the recording mechanism unit 203 which is relatively moved with respect to the recovery mechanism unit 204, and the wiper holder 18 can wipe the discharge port surface 81 while maintaining the relative position between the wipers 8 and 9 and the discharge port surface 81 both in the insertion direction to the recording means 3 and in the discharge port array direction, to be positioned at the optimum position. Therefore, even if the convex part 3*e* exists in the discharge port surface 81, the relative position between the recording means and the wiper can be controlled at the appropriate position by the simple and inexpensive configuration in wiping the discharge port surface, and the discharge port surface can securely be wiped.

Figure 15:
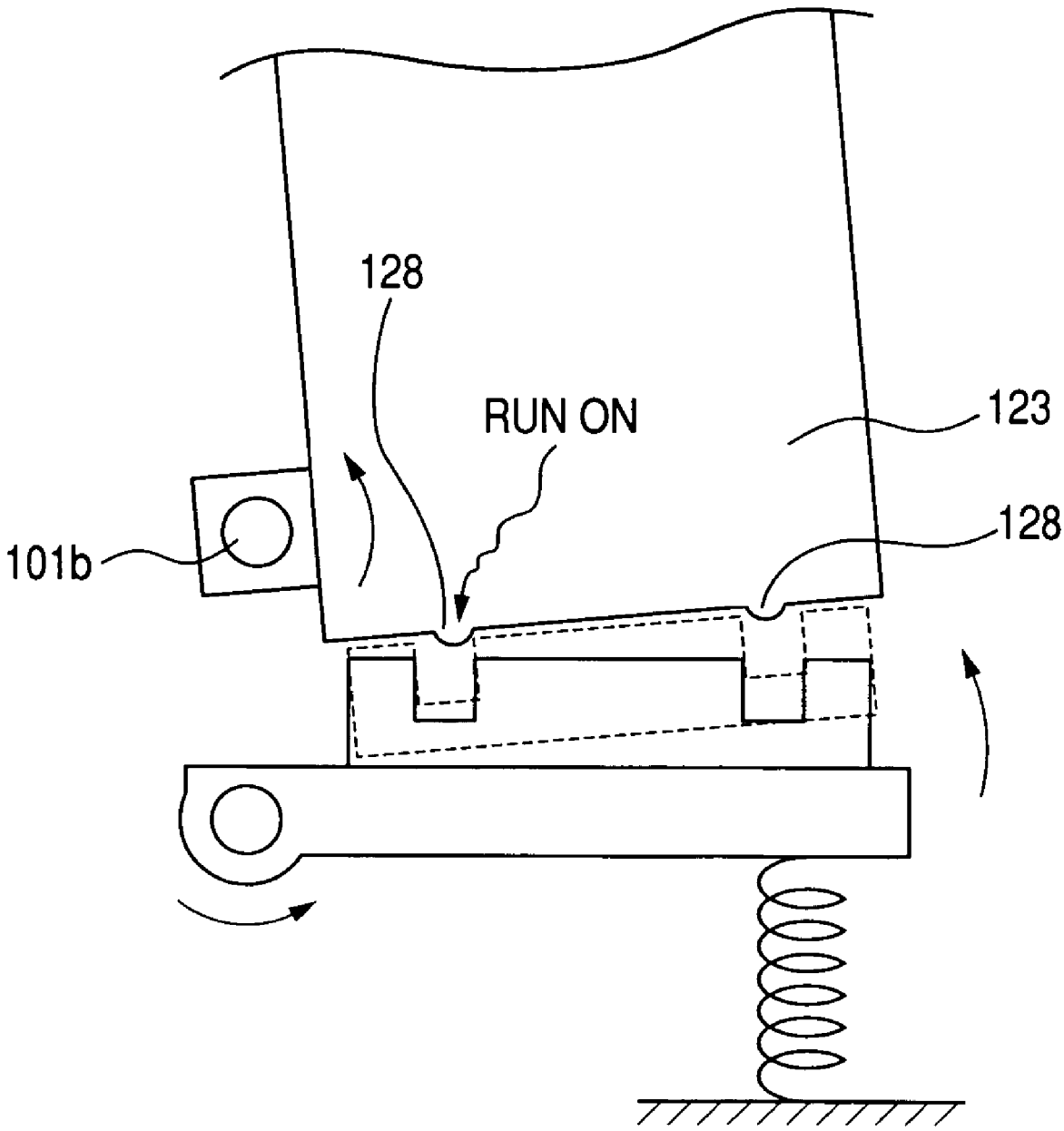
FIG. 15 is a front view showing a relative positional relationship between the wiper and the recording means when the recording mechanism unit is obliquely held in the conventional inkjet recording apparatus.
Figure 16:
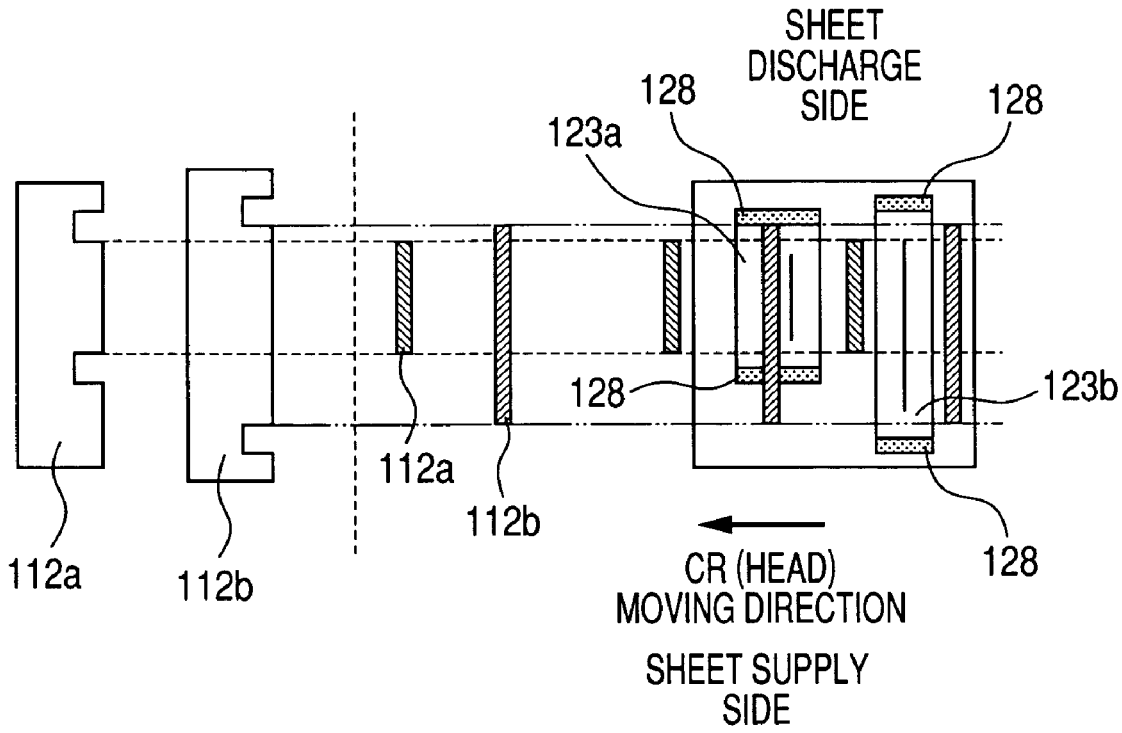
FIG. 16 is an explanatory view illustrating each discharge port array of the recording means and a wiper configuration and arrangement when the wiper wipes respective discharge port arrays and the convex parts of the discharge port arrays.
Figure 17A:
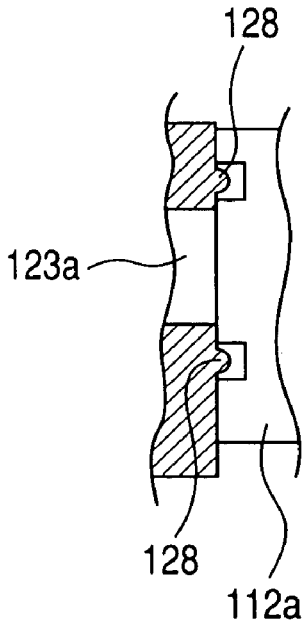
FIGS. 17A and 17B are explanatory views showing a state in which wiping is performed while the wiper avoids the convex parts of a color discharge port unit in a discharge port surface of the recording means.
Figure 17B:
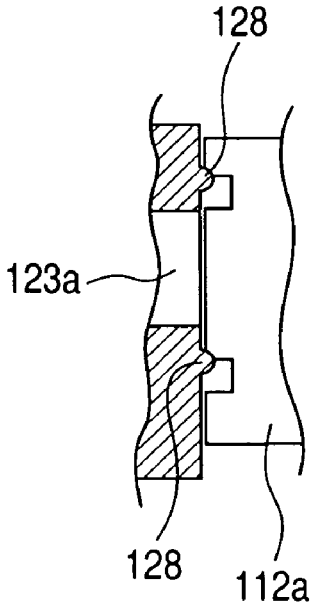

As shown in FIG. 15, even if the carriage is supported while being rotatable about the guide shaft in order to adjust the sheet-gap between the discharge port surface and the recording material, the parallelism of the wiper relative to the discharge port surface 81 can be maintained while the relative position in the wiper insertion amount direction can be corrected, by abutting the abutting portions 18*a* and 18*c* on the recording mechanism unit 203. Further, with respect to the relative position of the wiper in the discharge port array direction, the discharge port surface 81 can be wiped while the relative position between the discharge port surface 81 and the wipers 8 and 9 is positioned at the optimum position regardless of an attitude of the carriage 6, by abutting and sliding the abutting portion 18*b* on the slide surface 5*b* of the recording mechanism unit 203.

When the carriage 6 is further moved toward the return direction after the wiping, a lock lever releasing projection 5*c* provided in the carriage unit 203 presses a leading end portion 16*c* of the lock lever 16 to rotate the lock lever 16 counterclockwise in FIG. 14 about the projection 7*b* of the slide member 7, which releases the latching of the lock lever 16 (latching between the cam surface 16*b* and vertical plane of the cam portion 13*b*). Therefore, the slide member 7 can be returned to the position (position before the carriage 6 makes the entry as shown in FIG. 9) where the cap 1 retracts completely from the recording means 3.

In the embodiment, for example in a case where the suction recovery process is not performed, such as a case where the recording action is performed without performing the wiping action after the capping is performed in order to prevent the discharge port portion of the recording means 3 from drying, the recording mechanism unit (carriage unit) 203 reverses the moving direction from the state in which the slide member 7 is pushed into the capping position (FIG. 10) by the recording mechanism unit 203, and the recording mechanism unit 203 is moved toward the direction in which the recording mechanism unit 203 retracts from the recovery mechanism unit 204. Therefore, the recording mechanism unit 203 retracts while the cam portion 16*b* of the lock lever 16 is not locked with the cam portion 13*b* of the base portion 13, which allows the slide member 7 to follow the carriage 6 to be moved to the position shown in FIG. 9. Accordingly, whether the wiping action is performed or not can be selectively changed by the position into which the carriage 6 pushes the slide member 7.

As described above, in the embodiment, the inkjet recording apparatus includes: the recording means 3 for discharging the ink to perform the recording on the recording material; the carriage 6 mounting thereon the recording means which is moved; the slide member 7 which can be moved by following the movement of the carriage; and the wiper holder which holds the wipers 8 and 9 for wiping the discharge port surface 81, the wiper holder 18 being mounted on the slide member 7 so as to be displaceable in the direction perpendicular to the discharge port surface, wherein, in wiping the discharge port surface 81, the relative position between the wipers 8 and 9 and the carriage 6 or the recording means 3 is positioned in the direction perpendicular to the discharge port surface by abutting the wiper holder 18 on the carriage 6 or the recording means 3. The wiper holder 18 is also mounted on the slide member 7 so as to be displaceable in the direction of the discharge port arrays 3*c* and 3*d* provided in the discharge port surface 81. The wiper holder 18 abuts onto the carriage 6 or the recording means 3 in wiping the discharge port surface 81, and thereby the relative position between the wipers 8 and 9 and the carriage or the recording means is positioned in the direction of the discharge port arrays 3*c* and 3*d*.

The embodiment adopts the configuration having: the slide member latching means for stopping the carriage 6 by latching the carriage 6 into the slide member 7 at the position where after the cap 1 is caused to closely contact the discharge port surface 81 by the movement of the carriage 6, the carriage 6 is further moved in the same direction, the slide member latching means including the lock lever 16, the cam portions 13*b* and 16*b*, and the like; and the slide member releasing means for releasing the latch between the carriage 6 and the slide member 7 when the recording means 3 passes through the wipers 8 and 9 after the slide member 7 reverses from the stop position, the slide member releasing means including the projection 5*c*, the leading end portion 6*c*, the lock lever 16, and the like. Further, in the embodiment, whether the wipers 8 and 9 wipe the discharge port surface 81 or not can selectively be changed depending on whether the carriage 6 further makes the entry from the capping position where the cap 1 is caused to closely contact the discharge port surface 81 into the position where the slide member latching means (including the lock lever 16, the cam portions 13*b* and 16*b*, and the like) is latched or not.

According to the embodiment, the wiper holder 18 abuts onto a part of the recording mechanism unit 203, which is movably formed while the recording means 3 is mounted on the carriage 6, thereby positioning the relative position between the wipers 8 and 9 and the recording means 3 in the direction intersecting the discharge port surface 81. Therefore, the inkjet recording apparatus with the simple and inexpensive configuration, in which the relative position between the recording means 3 and the wipers 8 and 9 can be controlled at the appropriate position in wiping the discharge port surface 81, is provided. For example, the inkjet recording apparatus according to the invention can securely perform the wiping, even if the convex part 3*e* is formed on the discharge port surface 81. In the recording mechanism unit 203 according to the embodiment, the carriage 6 and the carriage cover 5 are separately formed, and the slide surfaces 5*a*, 5*b*, and 6*a* by which the wiper holder 18 is positioned are provided in the carriage 6 and the carriage cover 5 respectively. However, it is also possible that the slide surfaces are appropriately provided in the carriage 6 or the carriage cover 5, and it is also possible that the slide surfaces are appropriately provided in the recording means 3 mounted on the carriage 6. When the carriage cover 5 is not provided, it is possible that the carriage 6 or the recording means 3 is appropriately selected and provided as the region in which the slide surface is formed.

Since the carriage cover 5 is fixed to the carriage 6, the term "carriage" includes the carriage cover 5 as the member in which the slide surface is provided, the member which is attached to the carriage cover 5, and the member which is attached to the carriage 6. Accordingly, in the invention, "carriage" indicating the region where the abutting portion (slide surface) is provided has a concept including not only the carriage 6 and the carriage cover 5 but also all the members provided in the recording mechanism unit (carriage unit) 203.

Even if the recording mechanism unit 203 has any configuration, the invention can be also applied, and the same effects can be obtained.

In the embodiment, the inkjet recording means in which the four colors of ink are used to perform the recording is shown as an example of the recording means 3. However, the invention can be also applied to the inkjet recording apparatus in which only one recording means for performing the recording with single-color (or monochrome) or multi-color is used, the inkjet recording apparatus in which the plural recording means for performing the recording with different colors of ink are used, a gray-scale recording apparatus in which the plural recording means for performing the recording with the same color and different densities are used, and the inkjet recording apparatus having the configuration in which these methods are combined. In these cases, the same effects can also be achieved.

The invention can be also applied to any arrangement configuration between the recording means and the ink tank, and the same effects can also be obtained. Examples of the arrangement configuration include the configuration having an exchangeable ink cartridge in which the recording means and the ink tank are integrally formed and the configuration in which the recording means and the ink tank are separately formed and connected to each other with an ink supply tube and the like. When the invention is applied to the inkjet recording apparatus, the invention can also be applied to the inkjet recording apparatus having the recording means in which an electro-mechanical conversion element such as piezoelectric element is used. Among others, the invention brings the excellent effects in the inkjet recording apparatus having the recording means in which the ink is discharged by utilizing the thermal energy. This is because high density and high resolution in the recording can be achieved in the thermal energy type inkjet recording apparatus.

According to the invention, the wiper holder abuts onto the carriage or the recording means, which allows the relative position between the wiper and the carriage or the recording means to be positioned in the direction perpendicular to the discharge port surface. Therefore, the inkjet recording apparatus with the simple and inexpensive configuration, in which the relative position between the recording means and the wiper can be controlled at an appropriate position in wiping the discharge port surface, is provided. For example, the inkjet recording apparatus according to the invention can securely perform the wiping, even if the convex part is formed on the discharge port surface.

This application claims priority from Japanese Patent Application No. 2004-148097 filed May 18, 2004, which is hereby incorporated by reference herein.

What is claimed is:

1. An inkjet recording apparatus which discharges ink to perform recording on a recording material, comprising:

a carriage unit, including a carriage and a recording head mounted thereon, which reciprocates in a first direction intersecting a second direction, which is a direction of an arrangement of a discharge port array formed on the recording head, wherein said carriage unit has slide surfaces;

a slide member which moves by following the movement of said carriage unit;

a wiper which wipes a discharge port surface of the recording head, the discharge port array being provided in the discharge port surface;

a wiper holder which holds said wiper, said wiper holder being held on said slide member so as to be displaceable relative to said slide member both in the second direction and in a third direction intersecting the first and the second directions;

a first spring which displaceably supports said wiper holder in the second direction relative to said slide member; and a second spring which displaceably supports said wiper holder in the third direction relative to said slide member;

wherein, when said carriage unit moves in the first direction relative to said wiper to wipe the discharge port surface with said wiper, predetermined portions of said wiper holder abut onto the slide surfaces of said carriage unit so as to maintain a relative position between said wiper and the discharge port surface in the second and the third directions, while the predetermined portions are slidable on the slide surfaces in the first direction.

2. The inkjet recording apparatus according to claim 1, wherein said slide member holds a cap with which the discharge port surface is covered.

3. The inkjet recording apparatus according to claim 2, further comprising:

a latching mechanism configured to latch said slide member to stop said slide member at a stop position where after the cap closely contacts the discharge port surface by the movement of said carriage unit, said carriage unit is further moved in the same direction; and a releasing mechanism configured to release the latching between said carriage and said slide member, when said slide member reverses from the stop position and the recording head passes through said wiper.

4. The inkjet recording apparatus according to claim 3, wherein whether the discharge port surface is wiped or not is selectively changeable depending on whether said carriage unit is moved to the position where said latching mechanism latches said carriage unit or not.

5. The inkjet recording apparatus according to claim 1, further comprising a guide shaft which guides movement of said carriage unit, wherein by rotation of said carriage unit around said guide shaft, a distance between the discharge port surface and the recording material is changed.

6. The inkjet recording apparatus according to claim 1, wherein the discharge port surface includes a convex part.

* * * * *